United States Patent [19]

Martin

[11] Patent Number: 4,666,462

[45] Date of Patent: May 19, 1987

[54] CONTROL PROCESS FOR GASIFICATION OF SOLID CARBONACEOUS FUELS

[75] Inventor: Michael C. Martin, Houston, Tex.

[73] Assignee: Texaco Inc., White Plains, N.Y.

[21] Appl. No.: 868,501

[22] Filed: May 30, 1986

[51] Int. Cl.[4] ..... C10J 3/46

[52] U.S. Cl. ..... 48/197 R; 44/51; 48/202; 48/DIG. 7; 48/DIG. 10; 48/206; 406/12; 406/29; 406/197

[58] Field of Search ..... 48/197 R, 202, 206, 48/209, 203, DIG. 7, DIG. 10; 252/373; 44/51; 406/12, 19, 29, 31, 197; 364/502

[56] References Cited

U.S. PATENT DOCUMENTS

| | | | |
|---|---|---|---|
| 3,514,217 | 5/1970 | Reiss | 406/19 |
| 3,607,157 | 9/1971 | Schlinger et al. | 48/206 |
| 3,940,184 | 2/1976 | McCain | 406/12 |
| 4,390,957 | 6/1983 | Skarlos et al. | 364/502 |
| 4,479,810 | 10/1984 | Marion et al. | 48/DIG. 10 |
| 4,481,015 | 11/1984 | Lusch et al. | 48/DIG. 7 |

*Primary Examiner*—Peter Kratz

*Attorney, Agent, or Firm*—Robert A. Kulason; James J. O'Loughlin; Albert Brent

[57] ABSTRACT

Control process for producing an aqueous slurry of solid carbonaceous fuel having a desired solids concentration for feed to a partial oxidation gas generator by grinding together in a size reduction zone a recycle aqueous slurry stream comprising carbon-containing particulate solids, a stream of solid carbonaceous fuel, and a specific amount of make-up water. No valves are in the line or path between the size reduction zone and the feed tanks for the solid carbonaceous fuel and recycle aqueous slurry. A system control unit automatically calculates the amount of make-up water and provides a corresponding signal to control the flow rate. Input signals that are provided to the system control unit include those corresponding to the weigh belt feeder speed and moisture content for the solid carbonaceous fuel; and pump speed, weight fraction, temperature, and density of the solids for the slurry of recycle particulate solids.

7 Claims, 2 Drawing Figures

CONTROL PROCESS FOR GASIFICATION OF SOLID CARBONACEOUS FUELS

FIELD OF THE INVENTION

This invention relates to the partial oxidation of aqueous slurries of solid carbonaceous fuel. More particularly, it is concerned with a control process for producing an aqueous slurry comprising solid carbonaceous fuel and recycle carbon-containing particulate solids of a desired solids concentration for feed to a partial oxidation gas generator.

BACKGROUND OF THE INVENTION

The partial oxidation of aqueous slurries of solid carbonaceous fuel for the production of synthetic gas, reducing gas, and fuel gas is a well known process, such as described in coassigned U.S. Pat. Nos. 3,607,157; 3,764,547 and 3,847,564, which are incorporated herein by reference. A control system with valves in the feedlines for controlling the feed to a gas generator is described in coassigned U.S. Pat. No. 4,479,810. The hot raw process gas stream from the gasifier is quench cooled and scrubbed with water to remove carbon-containing particulate matter that is entrained in the raw gas stream. Aqueous slurries of the particulate matter ground with fresh raw solid carbonaceous fuel and recycled to the gas generator are described in coassigned U.S. Pat. No. 3,607,157.

The Texaco coal gasification process produces three solids-containing streams. These are: coarse slag, fine slag and settler underflow. Much data collected from pilot unit test runs indicate that the fine slag and settler underflow streams contain higher carbon contents than the coarse slag stream. Therefore, the fuel value of these streams may be significant, particularly for petroleum coke gasification where carbon conversions are low. Additionally, the settler underflow stream is contaminated with process water. This process water contains formates, cyanates, dissolved heavy metals and other contaminates that may give rise to problems with permitting the disposal of the settler underflow stream. Therefore, from both an efficiency and environmental standpoint, it is desirable to recycle the fine slag and settler underflow. In the past, solids recycle schemes have involved controlling the flow rate of the recycle solids streams through a control valve. The experience gained with coal gasification units is that the settler underflow stream is highly abrasive and destroys control valves after a short period of operation. Another problem with past recycle solids schemes is that the control of the system depends on on-line density measurements by density meters. The experience gained is that density meters are good for trending purposes but will not be accurate enough for control purposes.

By the subject invention, an improved method for producing an aqueous slurry having a controlled solids content has been developed which has the following advantages over previous concepts:

1. No control valves are used to control the solids recycle stream. As stated above, these valves are failure prone.
2. No density meters are used to control the process. As stated above, density meters are not sufficiently accurate for control purposes.

SUMMARY OF THE INVENTION

This is an improved method for producing an aqueous slurry comprising solid carbonaceous fuel and recycle carbon-containing particulate solids of a desired solids concentration for feed to the partial oxidation gas generator comprising:

(1) introducing the solid carbonaceous fuel feed directly into a size reduction zone, wherein weigh belt feeding means controls the feed rate of the solid carbonaceous fuel feed and there is no valving means in the flow path between the weigh belt feeding means and the size reduction zone;

(2) periodically measuring the weigh belt feeder speed and response thereto providing a signal corresponding to the feed rate for the solid carbonaceous fuel in (1) on a weight basis;

(3) periodically determining the weight fraction of moisture in the solid carbonaceous fuel in (1) and generating a signal responsive thereto;

(4) pumping an aqueous slurry of recycle carbon-containing particulate solids directly into said grinding means with no valving means in the line;

(5) periodically measuring the speed of the pump in (4), and responsive thereto providing a signal corresponding to the volumetric feed rate of said slurry of recycle particulate solids;

(6) periodically determining the weight fraction of recycle particulate solids in the slurry in (4) and generating a signal responsive thereto;

(7) periodically measuring the temperature of the slurry in (4) and as a function of said temperature providing a signal corresponding to the density of water at said temperature;

(8) periodically determining the density of the particulate solids in (4) and generating a signal responsive thereto;

(9) automatically computing a value representing the desired rate of flow for the make-up water to be introduced into said size reduction zone in order to provide a slurry of desired solids concentration from the signals generated in (2), (3), (5), (6), (7), (8), and direct current voltage input signals including a signal representing said desired slurry solids concentration; and responsive thereto providing a related signal to a flow recorder rate controlling means which provides an adjustment signal to a valve in the make-up water line, thereby providing make-up water with the desired rate of flow; and

(10) grinding together said solid carbonaceous fuel feed from (1), slurry of recycle particulate solids from (4), and make-up water from (9) in said size reduction zone to produce an aqueous slurry with said desired solids concentration; and introducing said slurry into the partial oxidation gas generator as the fuel feed.

DESCRIPTION OF THE INVENTION

In the Texaco partial oxidation coal gasification process, such as shown and described in coassigned U.S. Pat. No. 3,607,157, ground solid carbonaceous fuel is introduced into the gas generator either alone or in the presence of a substantially thermally vaporizable hydrocarbon and/or water, or entrained in a temperature moderator such as steam, $CO_2$, $N_2$ and recycle synthesis gas. For example, the following low-cost readily available ash-containing solid carbonaceous fuels are suitable feedstocks and include by definition: coal i.e. anthracite, bituminous, subbituminous, or lignite; particulate carbon; coke from coal; petroleum coke; oil shale; tar sands; asphalt; pitch; and mixtures thereof. The term free-oxygen containing gas, as used herein is intended to include air, oxygen-enriched air, i.e. greater than 21 mole % oxygen, and substantially pure oxygen, i.e. greater than 95 mole % oxygen (the remainder comprising $N_2$ and rare gases).

The partial oxidation reaction takes place in the reaction zone of a refractory lined free-flow gas generator at a temperature in the range of about 1700° F. to 3000° F. and a pressure in the range of about 1 to 300 atmospheres such as about 5 to 200 atmospheres. The atomic ratio oxygen/carbon (O/C) is in the range of about 0.5 to 1.7, such as about 0.7 to 1.2. The wt. ratio $H_2O$ to fuel is in the range of about 0.1 to 5.0, such as about 0.3 to 3.0. The effluent gas stream from the gas generator comprises $H_2$, CO, $CO_2$ and at least one material from the group consisting of $H_2O$, $H_2$, COS, $N_2$, and Ar. Entrained particulate matter and slag may also be entrained in the raw effluent gas stream.

Figure 1:
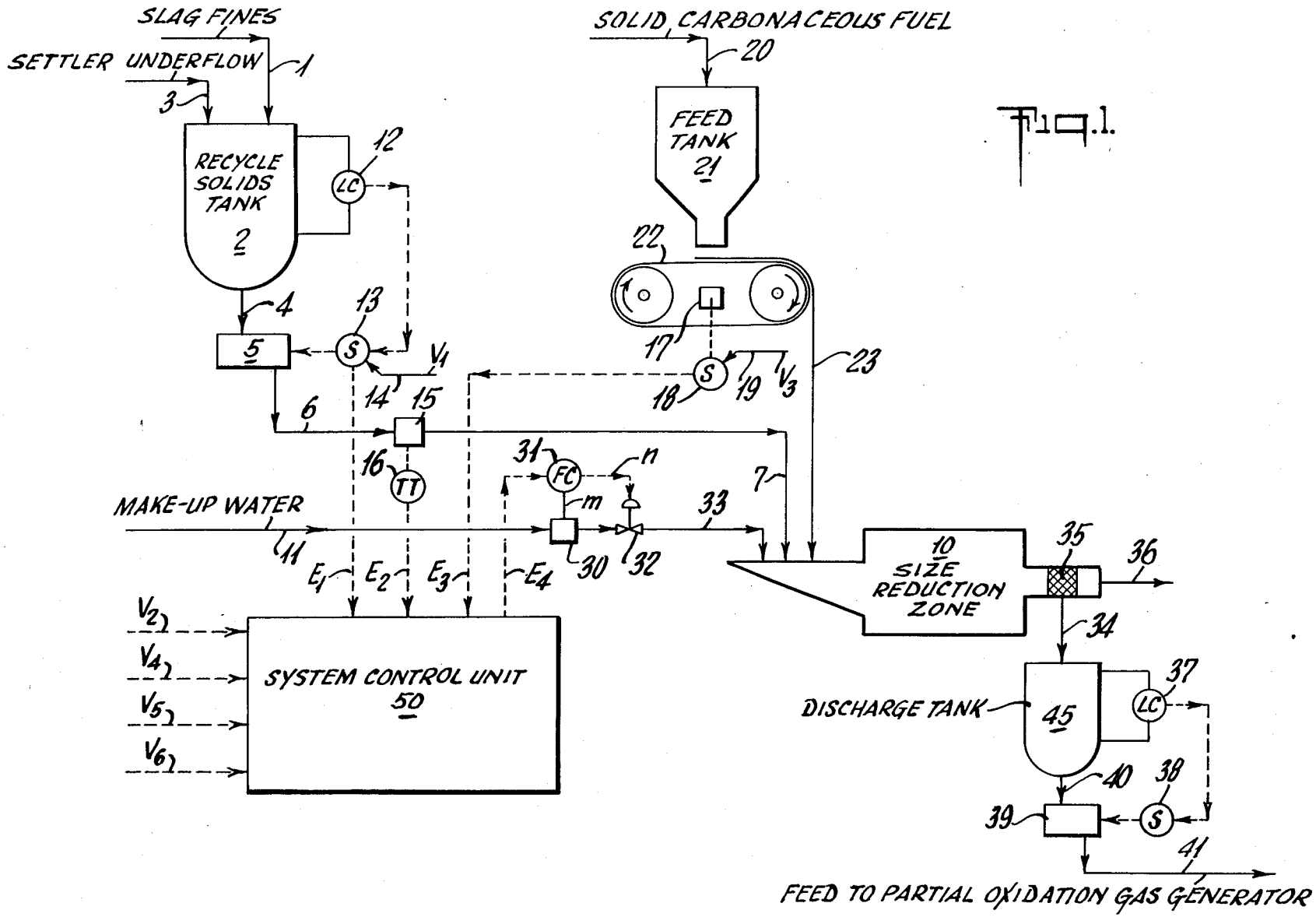
FIG. 1 is a simplified block diagram of the control process for gasification of solid carbonaceous fuel constructed in accordance with the present invention.

With reference to FIG. 1 of the drawing, a stream of aqueous suspension or slurry of carbon-containing slag fines in line 1 having a particle size such that 100% passes through a 14 mesh sieve is mixed in recycle solids slurry tank 2 with a settler underflow stream comprising carbon-containing particulate matter having a particle size such that 100% passes through a 14 mesh sieve from line 3. For example, streams 1 and 3 may be respectively provided with reference to the drawing in coassigned U.S. Pat. No. 3,607,157, which is incorporated herein by reference, by the aqueous suspension or slurry from line 60 at the bottom of quench tank 20 of partial oxidation synthesis gas generator 12, and the aqueous suspension or slurry in line 36 at the bottom of sedimentation vessel 35. Referring to the FIG. 1 of the subject application the amount of wash water in the slurry in line 7 should be such that a minimum of make up water from line 11 is required for introduction into size reduction zone 10. That is, there is less water in the slurry in line 7 plus the moisture in the solid carbonaceous fuel in path 23 than that which is required in the slurry being fed to the gasifier from line 41. The solids content in the slurry in lines 6 and 7 is in the range of about 50 to 70 wt. %, such as about 55 to 65 wt. %. The size of the solid particles in the suspension in line 6 is such that 100% passes through a 14 mesh sieve.

The aqueous suspension or slurry of carbon-containing particulate solids in line 4 of the drawing is pumped by means of positive displacement pump 5 through lines 6 and 7 containing no valve and into size reduction zone 10. The level in recycle solids tank 2 is controlled by liquid level indicator and control 12 and may be adjusted by manually setting pump speed control 13. Direct current voltage $V_1$ corresponding to the desired speed setpoint is inserted in pump speed control and transmitter 13 by way of line 14. The desired speed setpoint may be manually or computer calculated. Signal $E_1$ corresponding to the speed of pump 5 is provided to system control unit 50 by speed control indicator and transmitter 13. The volumetric flowrate of recycle slurry stream in line 7 e.g. $v_7$ is equal to constant $k_1$ times the speed of pump 5. Preferably, the units for the volumetric flow rate are cubic ft. per minute. The value of $k_1$ is determined by pump design and may be in the range of about 0.05 to 1.5 cubic feet/revolution, such as about 0.35 cubic feet/revolution. $V_8$ is a direct current voltage corresponding to $k_1$ and may be manually inserted in system control unit 50. The temperature of the aqueous suspension in line 6 is determined by temperature sensor 15 which provides an electrical signal to temperature indicator and transmitter 16. The density of water in the slurry is a function of the temperature of the aqueous suspension. Preferably, the units for density are pounds per cubic ft. The density is easily determined from the temperature either manually or electronically from readily available data. See Chemical Engineers' Handbook, Perry and Chilton, which is incorporated herein by reference. Signal $E_2$, corresponding to the density of the water in line 6 at that temperature is provided to system control unit 50 by temperature indicator and transmitter 16.

The wt. % of solids in the aqueous suspension of comminuted solids in line 7 is determined at least once a day. Direct current voltage $V_2$ corresponding to the wt. % of comminuted solids in line 7 is inserted in system control unit 50 either manually or electronically.

Fresh solid carbonaceous fuel having a particle size so that 100% passes through a ¾" mesh sieve in line 20 is introduced into feed tank 21. The solid carbonaceous fuel is then fed by gravity into a conventional weigh belt feeder 22 where it is automatically and continuously weighed. A suitable bulk continuous weigher that is sensitive both to the total amount of material flowing and to changes in the flow is shown in FIGS. 7–36 of Chemical Engineers' Handbook, Perry and Chilton, Fifth Edition McGraw-Hill Book Co., and is incorporated herein by reference.

The solid carbonaceous fuel is continuously brought over the weight-sensing elements of the continuous weigh scale, which is capable of keeping track of the flow and its changes and eventually accounts for these when totaling them. Sensor 17 detects the weight of solid carbonaceous fuel passing over the belt and provides a signal to rate indicator and transmitter 18 corresponding to the weight of solid carbonaceous fuel being fed. Direct current voltage $V_3$ corresponding to the manually or computer calculated desired belt speed setpoint is inserted in rate controller indicator and transmitter 18 by way of line 19. The rate of solid carbonaceous fuel feed to size reduction zone 10 by way of path 23 containing no valves is determined by rate indicator and transmitter 18. Preferably, the units are pounds per minute. A corresponding signal $E_3$ is provided to system control unit 50. The continuous weigher is used to feed the solid carbonaceous fuel to size reduction zone 10 at a uniform measured rate. The solid carbonaceous fuel moves off the conveyor belt and falls by gravity through path 23 into size reduction zone 10.

Periodically, for example once a day, the weight percent moisture in the solid carbonaceous fuel on weigh belt feeder 22 is determined. Direct current voltage $V_5$ corresponding to the weight percent moisture in the solid carbonaceous fuel is manually or electronically inserted into system control unit 50.

The rate of make-up water in line 11 is measured by flow rate sensor 30, and signal m is provided corresponding to the present flow rate in line 11. Flow rate control and transmitter 31 receives signal m and compares it with signal $E_4$ representing the desired rate of flow that is required to provide the additional weight of make-up water, as determined by system control unit 50, in order to produce the aqueous slurry in line 41 having the desired solids content. Flow rate control and transmitter 31 then provides a corresponding adjustment signal n to valve 32 so that the additional make-up water required to produce the feed slurry with the desired solids concentration in line 41 may be passed through line 33 into size reduction zone 10. Preferably, the units are pounds per minute. Preferably, valve 32 is normally closed unless it is provided with an adjustment signal.

Size-reduction zone 10 comprises any suitable type of size-reduction equipment, for example ball mills. Conventional crushers and mills for solid carbonaceous fuel are discussed beginning on page 8–16 of Chemical Engineers' Handbook, Perry and Chilton, Fifth Edition, McGraw-Hill Book Co.

The aqueous suspension of comminuted solid carbonaceous fuel is passed through screen 35. Solid particles having a size of greater than a 4 mesh screen are removed through line 36 and recycled to size reduction zone 10 by way of line 20. The remainder of the suspension having the desired weight percent of comminuted solids with a particle size such that 100% passes through a 4 mesh sieve is then discharged into holding tank 45. The level of aqueous suspension in tank 45 as indicated by level control 37 is controlled by speed control 38 which controls the speed of pump 39. The aqueous suspension is pumped through line 40 at the bottom of discharge tank 45 and line 41 into the partial oxidation gas generator (not shown) as the fuel.

Direct current voltage $V_6$ corresponding to the desired wt. % of comminuted solids in the suspension in line 41 is inserted in system control unit 50 as a setpoint. This value may be manually or computer calculated and so inserted.

The make-up water supplied through line 11 is calculated by system control unit 50 from the input signals described previously in FIG. 1 and the following equations:

Recycle Slurry Stream—line 7

The water and solids in recycle slurry stream line 7 may be determined in accordance with Equations I and II respectively.

$$H_2O_{line\ 7} = \rho_7 V_7\left(1 - \frac{R}{100}\right) \quad \text{I}$$

$$\text{Solids}_7 = \rho_7 V_7\left(\frac{R}{100}\right) \quad \text{II}$$

wherein:

R=wt. % of solids in the slurry stream line 7=signal $V_2$ $\rho_7$=density of slurry in line 7 (see equation III)

$v_7$=volumetric flow rate=$k_1 \times$speed of pump 5=signals $E_1 \times V_8$ $$\rho_7 = \frac{100}{\frac{100 - R}{\rho_w} + \frac{R}{\rho_{solids}}} \quad \text{III}$$

wherein:

$\rho_w$=density of water=function of temperature from signal $E_2$ $\rho_{solids}$=density of solid fuel=signal $V_4$ Solid Carbonaceous Fuel—line 23

The water and solids in the solid carbonaceous fuel in path 23 may be determined in accordance with Equations IV and V respectively.

$$H_2O_{path\ 23} = F\left(\frac{M}{100}\right) \quad \text{IV}$$

$$\text{Solids}_{23} = F\left(1 - \frac{M}{100}\right) \quad \text{V}$$

wherein:

F=coal feed rate=signal $E_3$

M=wt. % moisture in coal=signal $V_5$

Slurry Product—line 41

The water and solids in the slurry product in line 41 may be determined by Equations VI and VII respectively $$H_2O_{line\ 41} = \text{Solids}_{41}\left(\frac{100}{C} - 1\right) \quad \text{VI}$$

$$\text{Solids}_{41} = \text{Solids}_{23} + \text{Solids}_7 \quad \text{VII}$$

wherein: C=desired wt. % solids in slurry in line 41=signal $V_6$

Make-up Water—line 33

The make-up water in line 33 may be determined by the following equation VIII:

$$H_2O_{line\ 33} = H_2O_{line\ 41} - H_2O_{path\ 23} - H_2O_{line\ 7} \quad \text{VIII}$$

Substituting equations VI, IV and I respectively in equation VIII, the following equation IX is derived.

$$H_2O_{line\ 33} = \text{Solids}_{41}\left(\frac{100}{C} - 1\right) - F\left(\frac{M}{100}\right) - \rho_7 V_7\left(1 - \frac{R}{100}\right) \quad \text{IX}$$

By substituting equation VII for $\text{solids}_{41}$ in equation IX the following equation X is derived:

$$H_2O_{line\ 33} = \left[F\left(1 - \frac{M}{100}\right) + \rho_7 V_7\left(\frac{R}{100}\right)\right]\left(\frac{100}{C} - 1\right) - F\left(\frac{M}{100}\right) - \rho_7 V_7\left(1 - \frac{R}{100}\right)$$

Figure 2:
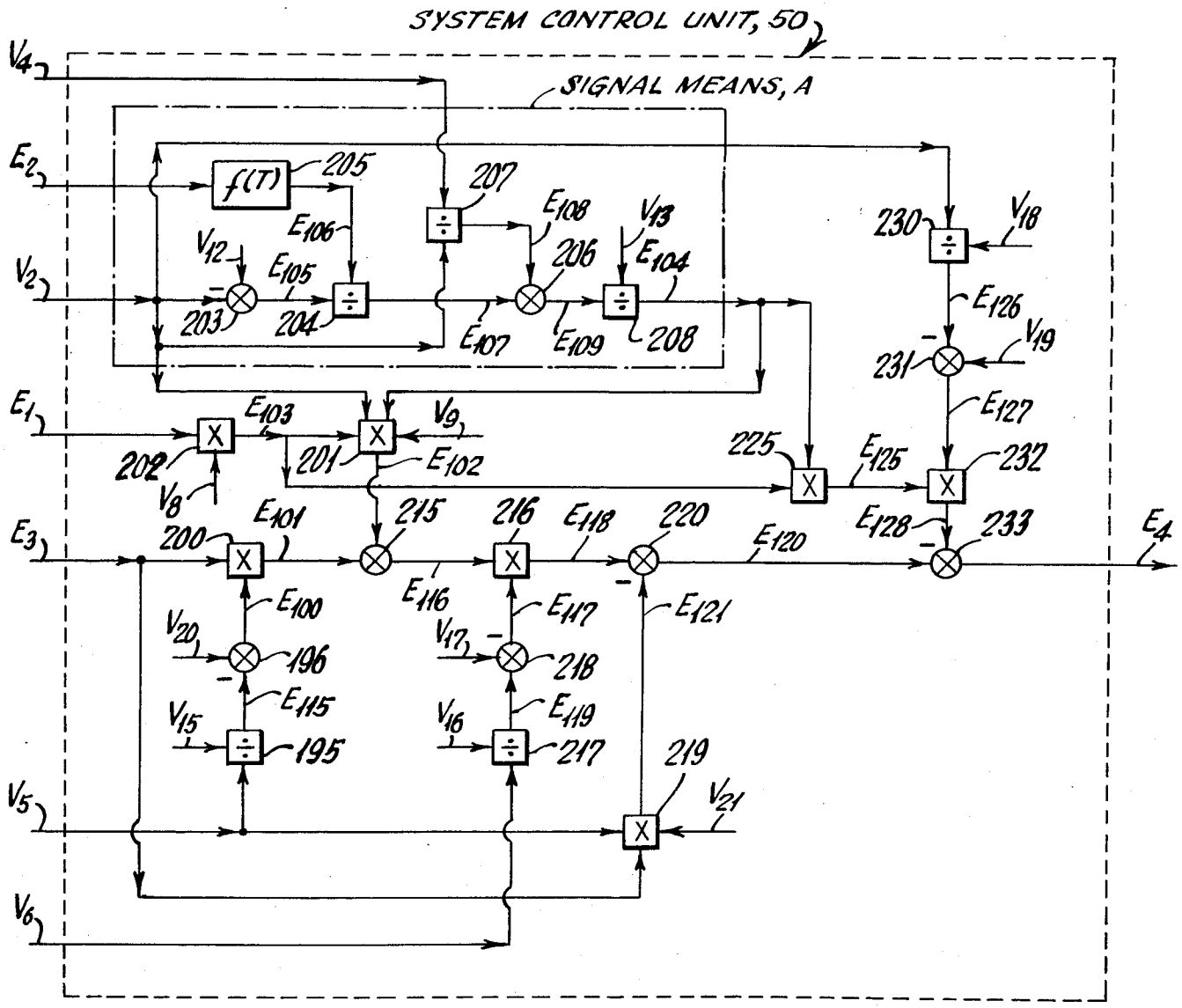
FIG. 2 is a detailed block diagram of the system control unit shown in FIG. 1.

System control unit 50 for electronically computing the make-up water in line 33 is shown in FIG. 2 and specified in equation X. Operation of system control Unit 50 is as follows:

Signal $E_3$ corresponding to F, the solid carbonaceous fuel feed rate, and signal $E_{100}$ corresponding to the combination $$\left(1 - \frac{M}{100}\right)$$

as shown in equation V are multiplied by multiplier 200 to generate signal $E_{101}$. Signal $E_{101}$ corresponds to $solids_{23}$ in equation V. Signal $E_{100}$ is provided by dividing by divider 195 signal $V_5$ corresponding to the solid carbonaceous fuel feed rate by direct current voltage $V_{15}$ corresponding to the integer 100 to produce signal $V_{106}$. In subtractor 196, signal $E_{115}$ is subtracted from direct current voltage signal $V_{20}$, which corresponds to the integer 1, to provide signal $E_{100}$.

Signal $E_{102}$ corresponding to $solids_7$ in equation II is derived by multiplying the following signals by multiplier 201: (1) signal $E_{103}$ provided by multiplying by multiplier 202 signal $E_1$ corresponding to the speed of recycle solids slurry pump 14 and direct voltage $V_8$ corresponding to pump constant $k_1$; (2) signal $E_{104}$ corresponding to $\rho_7$ the computed value for the density of the slurry in line 7 from equation III; (3) signal $V_2$ corresponding to the wt. % of recycle solids; and (4) direct current voltage $V_9$ corresponding to the value 0.01.

$\rho_7$ as shown in equation III is produced in signal means A, as follows: direct current voltage signal $V_2$ corresponding to the wt. % of recycle solids is subtracted from direct voltage signal $V_{12}$ corresponding to the integer 100 in subtractor 203 thereby providing signal $E_{105}$. In divider 204, signal $E_{105}$ is divided by signal $E_{106}$ corresponding to the density of water in the slurry in line 7 to provide signal $E_{107}$.

Signal $E_{106}$ is provided by introducing signal $E_2$ representing the slurry temperature into density function generator 205. Signal $E_{107}$ is added to signal $E_{108}$ in adder 206 to provide signal $E_{109}$. Signal $E_{108}$ is provided by dividing in divider 207, signal $V_2$ by direct current voltage signal $V_4$ corresponding to the measured density of the solid matter in the slurry in line 7. In divider 208, the direct current voltage signal $V_{13}$ corresponding to the integer 100 is divided by signal $E_{109}$ to provide signal $E_{104}$ corresponding to the density of the slurry in line 7.

Signal $E_{101}$ representing the combination $$F\left(1 - \frac{M}{100}\right)$$

in equation X and V and signal $E_{102}$ representing the combination $\rho_7 v_7(R/100)$ in equations X and II are added together in adder 215 to provide signal $E_{116}$. Signal $E_{116}$ is multiplied by multiplier 216 with signal $E_{117}$ which corresponds to the combination $$\left(\frac{100}{C} - 1\right)$$

in equations X and VI to provide signal $E_{118}$. Signal $E_{117}$ is provided by dividing in divisor 217, direct current voltage $V_{16}$ corresponding to the integer 100 by signal $V_6$ corresponding to the desired slurry concentration in line 41 to provide signal $E_{119}$; and subtracting direct current voltage signal $V_{17}$ representing the integer 1 from signal $E_{118}$ in subtractor 218.

Signal $E_{121}$ representing the combination F(M/100) from equations X and IV is provided by multiplying in multiplier 219, signal $E_3$, signal $V_5$, and a direct current voltage $V_{21}$ representing the value 0.01. Signal $E_{121}$ is subtracted from signal $E_{118}$ in subtractor 220 to provide signal $E_{120}$.

Signals $E_{103}$ and $E_{104}$ are multiplied together by multiplier 225 to provide signal $E_{125}$ representing the combination $\rho_7 v_7$. Signal $V_2$ is divided in divider 230 by direct current voltage signal $V_{18}$ representing the value 100 to provide signal $E_{126}$ representing the combination (R/100). Signal $E_{126}$ is subtracted in subtractor 231 from direct current voltage signal $V_{19}$ representing the value 1 to provide signal $E_{127}$ representing the combination $$\left(1 - \frac{R}{100}\right).$$

Signals $E_{125}$ and $E_{127}$ are multiplied together in multiplier 232 to provide signal $E_{128}$ representing the combination $$\rho_7 V_7\left(1 - \frac{R}{100}\right).$$

Signal $E_{128}$ is subtracted from signal $E_{120}$ in subtractor 233 to provide signal $E_4$ corresponding to the required weight of make-up water in line 33 and equation X. Signal $E_4$ from system control unit 50 is provided to flow rate controller 31 in make-up water line 11. Signal $E_4$ corresponds to the additional make-up water to be provided to size reduction zone 10 through line 33 so that the aqueous slurry in line 41 has the desired solids content. When $H_2O$ line 33 in Equation X is 0 or less, then signal $E_4$ is 0, no make-up water is required, and valve 32 is closed. In one embodiment, an alarm signal is generated according to the value of $E_4$.

The following example illustrates a preferred embodiment of this invention and should not be construed as limiting the scope of the invention.

EXAMPLE I

An aqueous slurry of coal is reacted in a partial oxidation free-flow gas generator. The hot product gas stream issuing from the reaction zone of the gasifier is immediately cooled in the quench chamber with water. Substantially all of the unconverted coal and carbon-containing ash is separated from the product gas stream, and an aqueous suspension of carbon-containing particulate solids e.g. ash, slag fines comprissing 800 pounds per minute of water and about 200 pounds per minute of carbon-containing solids is separated for recycle. The particle size of the solid material is such that 100 wt. % passes through a 14 mesh sieve. The solids content is about 20 wt. %.

In a recycle solids tank, the aforesaid suspension is combined with 578 pounds per minute of a suspension of settler underflow from the gas scrubbing zone, such as shown in coassigned U.S. Pat. No. 3,607,157. The suspension of settler underflow has a solids content of 20 wt. %. The particle size is such that 100 wt. % passes through a 14 mesh sieve.

An aqueous slurry of solids from the recycle solids tank is pumped into a ball mill. There are no valves in the line. A triplex reciprocating pump having a 6 inch diameter piston, a 8 inch stroke, and a speed of 65.9 revolutions/min. is used. The speed is sensed and a signal corresponding to the speed is introduced into the system control unit along with the pump constant of 0.385 cubic feet per revolution. A direct current voltage signal corresponding to the pump constant is entered into the system control unit. The temperature of the aqueous suspension is 85° F. The corresponding density of water at this temperature is 62.17 lb/cu. ft. A direct current voltage signal corresponding to the density of the solids in the slurry is entered into the system control unit and a signal corresponding to the density of the slurry in line 7 is automatically generated in accordance with Equation III.

Simultaneously by means of a weigh belt, 3500.0 pounds per minute of bituminous coal having a moisture content of 10.0 wt. % is introduced into the ball mill. There are no valves in the coal path. The speed of the weigh belt is 58 ft. per min. A signal corresponding to the weight of coal per minute, based on the belt feed, being fed to the ball mill is introduced into the system control unit, along with direct current voltage signals corresponding to the wt. % moisture in the coal, and the density of the coal.

A direct current voltage signal corresponding to the desired wt. % solids in the slurry discharged from the ball mill e.g. 65 wt. % is introduced into the system control unit along with various other direct current voltages corresponding to the constants 1;100 and 0.01.

From the aforesaid input signals and the previously discussed Equation X, the system control unit generates an output signal e.g. $E_4$ corresponding to the desired amount of make-up water e.g. 253.7 pounds per minute to be introduced into the ball mill in order for the slurry to be discharged from the ball mill at a solids concentration of 65.0 weight percent. Signal $E_4$ is introduced into a flow rate controller which provides a related signal to a control valve in the make-up water line. The aqueous slurry of fresh coal and recycle particulate solids is pumped into the partial oxidation gas generator as feedstock for the production of synthesis gas.

Although modifications and variations of the invention may be made without departing from the spirit and scope thereof, only such limitations should be imposed as are indicated in the appended claims.

I claim:

1. In a partial oxidation process for reacting an aqueous slurry of ash-containing solid carbonaceous fuel feedstream and a free-oxygen containing gas feedstream in the reaction zone of a refractory lined free-flow noncatalytic gas generator at a temperature in the range of about 1700° to 3000° F. and a pressure in the range of about 1 to 300 atmospheres to produce an effluent gas stream comprising $H_2$, CO, $CO_2$, at least one material from the group consisting of $H_2O$, $H_2S$, COS, $N_2$, and Ar and entrained particulate matter containing carbon; and cleaning and cooling the effluent gas stream with water in a gas quenching and cleaning zone to remove substantially all of the entrained particulate matter as an aqueous dispersion of recycle particulate solids and to produce a cooled and cleaned effluent gas stream: the improved method for producing an aqueous slurry comprising solid carbonaceous fuel and recycle carbon-containing particulate solids of a desired solids concentration for feed to the partial oxidation gas generator comprising:

(1) introducing the solid carbonaceous fuel feed directly into a size reduction zone, wherein weigh belt feeding means controls the feed rate of the solid carbonaceous fuel feed and there is no valving means in the flow path between the weigh belt feeding means and the size reduction zone;

(2) periodically measuring the weigh belt feeder speed and response thereto providing a signal corresponding to the feed rate for the solid carbonaceous fuel in (1) on a weight basis;

(3) periodically determining the weight fraction of moisture in the solid carbonaceous fuel in (1) and generating a signal responsive thereto;

(4) pumping an aqueous slurry of recycle carbon-containing particulate solids directly into said grinding means with no valving means in the line;

(5) periodically measuring the speed of the pump in (4), and responsive thereto providing a signal corresponding to the volumetric feed rate of said slurry of recycle particulate solids;

(6) periodically determining the weight fraction of recycle particulate solids in the slurry in (4) and generating a signal responsive thereto;

(7) periodically measuring the temperature of the slurry in (4) and as a function of said temperature providing a signal corresponding to the density of water at said temperature;

(8) periodically determining the density of the particulate solids and generating a signal responsive thereto;

(9) automatically computing a value representing the desired rate of flow for the make-up water to be introduced into said size reduction zone in order to provide a slurry of desired solids concentration from the signals generated in (2), (3), (5), (6), (7), (8), and direct current voltage input signals including a signal representing said desired slurry solids concentration; and responsive thereto providing a related signal to a flow recorder rate controlling means which provides an adjustment signal to a valve in the make-up water line, thereby providing make-up water with the desired rate of flow; and

(10) grinding together said solid carbonaceous fuel feed from (1), slurry of recycle particulate solids from (4), and make-up water from (9) in said size reduction zone to produce an aqueous slurry with said desired solids concentration; and introducing said slurry into the partial oxidation gas generator as the fuel feed.

2. The process of claim 1 where in step (9) said desired rate of flow for the make-up water is determined in accordance with equation X below:

$$H_2O_{make\text{-}up} = F\left[\left(1 - \frac{M}{100}\right) + \rho_7 V_7\left(\frac{R}{100}\right)\right]\left(\frac{100}{C} - 1\right) - F\left(\frac{M}{100}\right) - \rho_7 V_7\left(1 - \frac{R}{100}\right) \quad \text{X}$$

wherein:

F = solid carbonaceous fuel feed rate, wt. basis in step (1).

M = wt. % moisture in solid carbonaceous fuel in step (1).

$\rho_7$ = density of aqueous slurry in step (4).

$\nu_7$ = volumetric feed rate of aqueous slurry in step (4).

R = wt. % of recycle solids in aqueous slurry in steep (4).

C = desired solids concentration in slurry in step (10).

3. The process of claim 1 where said ash-containing solid carbonaceous fuel is selected from the group consisting of coal i.e. anthracite, bituminous, subbituminous, or lignite; particulate carbon; coke from coal; petroleum coke; oil shale; tar sands; asphalt; pitch; and mixtures thereof.

4. The process of claim 1 wherein said free-oxygen containing gas is selected from the group consisting of air, oxygen-enriched air, i.e. greater than 21 mole % oxygen, and substantially pure oxygen, i.e. greater than 95 mole % oxygen (the remainder comprising $N_2$ and rare gases).

5. The process of claim 1 wherein the total amount of water in the solid carbonaceous fuel in (1) and in the aqueous slurry of solid carbonaceous fuel in (4) is less than the water in the aqueous slurry produced in (10).

6. The process of claim 2 wherein $H_2O$ make-up in Equation X is 0 or less and the valve in the make-up water line in (9) is closed.

7. The process of claim 1 wherein an alarm signal is generated in accordance with the value of the desired rate of flow for the make-up water in (9).

* * * * *